US009587369B2

(12) United States Patent
Fletcher et al.

(10) Patent No.: US 9,587,369 B2
(45) Date of Patent: Mar. 7, 2017

(54) EXCAVATION SYSTEM HAVING ADAPTIVE DIG CONTROL

(71) Applicant: Caterpillar Inc., Peoria, IL (US)

(72) Inventors: Jeffrey Graham Fletcher, Peoria, IL (US); Daniel Aaron Jones, Tasmania (AU); Ranishka De Silva Hewavisenthi, Queensland (AU); Ricky Kam Ho Chow, Queensland (AU)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/790,397

(22) Filed: Jul. 2, 2015

(65) Prior Publication Data

US 2017/0002540 A1 Jan. 5, 2017

(51) Int. Cl.
*E02F 9/20* (2006.01)
*E02F 3/43* (2006.01)
(Continued)

(52) U.S. Cl.
CPC ..... *E02F 3/431* (2013.01); *E02F 3/283* (2013.01); *E02F 9/2029* (2013.01);
(Continued)

(58) Field of Classification Search
CPC . E02F 3/431; E02F 3/432; E02F 3/434; E02F 9/20; E02F 9/2029; E02F 3/283; G01G 19/10
(Continued)

(56) References Cited

U.S. PATENT DOCUMENTS 5,065,326 A 11/1991 Sahm
5,116,187 A * 5/1992 Fukuda ..... E02F 9/20 37/348
(Continued)

FOREIGN PATENT DOCUMENTS

CN 103292715 9/2013
WO WO 2010/074003 A1 7/2010

OTHER PUBLICATIONS

U.S. Patent Application entitled "Excavation System Providing Impact Detection" filed Jul. 7, 2015 by Jeffrey Graham Fletcher et al.
(Continued)

*Primary Examiner* — Yuri Kan
(74) *Attorney, Agent, or Firm* — Finnegan, Henderson, Farabow, Garrett & Dunner, LLP

(57) ABSTRACT

An excavation system is disclosed for a machine having a work tool. The excavation system may have a speed sensor to detect a travel speed of the machine and a load sensor to detect loading of the work tool. The excavation system may also have a controller configured to detect engagement of the work tool with a material pile based on at least one of the first signal and the second signal. The controller may also be configured to select at least one tilt control parameter value for the work tool and operate the work tool based on the selected tilt control parameter value to load the work tool with an amount of material. The controller may be configured to determine whether the amount of material exceeds a target amount and to cause the machine to withdraw from the material pile when the amount exceeds the target amount.

17 Claims, 9 Drawing Sheets

(51) Int. Cl.
*E02F 9/24* (2006.01)
*E02F 9/26* (2006.01)
*E02F 3/28* (2006.01)

(52) U.S. Cl.
CPC ..... *E02F 9/2041* (2013.01); *E02F 9/24* (2013.01); *E02F 9/268* (2013.01)

(58) Field of Classification Search
USPC ..... 701/50; 414/699, 722; 177/1; 700/97
See application file for complete search history.

(56) References Cited

U.S. PATENT DOCUMENTS 5,293,944 A 3/1994 Matsumoto
5,535,532 A 7/1996 Fujii et al.
5,617,724 A 4/1997 Ko
5,844,800 A * 12/1998 Brandt ..... E02F 3/431 299/13
5,960,378 A 9/1999 Watanabe et al.
5,968,103 A * 10/1999 Rocke ..... E02F 3/432 172/4.5
5,974,352 A * 10/1999 Shull ..... E02F 3/432 172/4.5
5,984,618 A * 11/1999 Deneve ..... E02F 3/283 414/697
6,205,687 B1 3/2001 Rocke
6,321,153 B1 11/2001 Rocke et al.
6,363,632 B1 4/2002 Stentz et al.
6,615,114 B1 9/2003 Skiba et al.
6,879,899 B2 4/2005 Budde
7,555,855 B2 7/2009 Alshaer et al.
7,640,683 B2 1/2010 McCain
7,658,234 B2 2/2010 Brandt et al.
7,797,934 B2 9/2010 Bacon et al.
7,853,382 B2 12/2010 Anderson
7,865,285 B2 1/2011 Price et al.
8,042,290 B2 10/2011 Hartwick
8,145,394 B2 3/2012 Chiorean et al.
8,160,783 B2 4/2012 Shull
8,280,596 B2 10/2012 Hagenbuch
8,363,210 B2 1/2013 Montgomery
8,478,492 B2 7/2013 Taylor et al.
8,527,155 B2 9/2013 Gudat
8,654,608 B2 2/2014 Lindskov
8,726,647 B2 5/2014 Peterson et al.
8,813,486 B2 8/2014 Peterson et al.
8,838,329 B2 9/2014 Seki
8,874,265 B2 10/2014 Rakshit
8,886,493 B2 11/2014 Taylor
8,903,689 B2 12/2014 Dunbabin et al.
2001/0056319 A1* 12/2001 Rocke ..... E02F 3/434 701/50
2007/0260380 A1* 11/2007 Mintah ..... E02F 9/2029 701/50
2012/0055051 A1 3/2012 Polston et al.
2013/0158789 A1 6/2013 Seki
2014/0277957 A1 9/2014 Clar et al.
2014/0291038 A1* 10/2014 Hague ..... G01G 19/10 177/1

OTHER PUBLICATIONS

U.S. Patent Application entitled "Excavation System Providing Automated Tool Linkage Calibration" filed Jul. 7, 2015 by Jeffrey Graham Fletcher et al.
U.S. Patent Application entitled "Excavation System Providing Automated Stall Correction" filed Jul. 7, 2015 by Jeffrey Graham Fletcher et al.
U.S. Application entitled "Excavation System Having Velocity Based Work Tool Shake" filed Jul. 7, 2015 by Jeffrey Graham Fletcher et al.

* cited by examiner

EXCAVATION SYSTEM HAVING ADAPTIVE DIG CONTROL

TECHNICAL FIELD

The present disclosure relates generally to an excavation system and, more particularly, to an excavation system having adaptive dig control.

BACKGROUND

Excavation, mining, or other earth removal activities often employ machines, such as load-haul-dump machines (LHDs), wheel loaders, carry dozers, etc. to remove (i.e. scoop up) material from a pile at a first location (e.g., within a mine tunnel), to haul the material to a second location (e.g., to a crusher), and to dump the material at the second location. Productivity of the material removal process depends on the efficiency of a machine during each excavation cycle. For example, the efficiency increases when the machine can sufficiently load a machine tool (e.g., a bucket) with material at the pile within a short amount of time, haul the material via a direct path to the second location, and dump the material at the second location as quickly as possible.

Some applications require operation of the machines under hazardous working conditions. In these applications, an operator or an automated system may remotely control some or all of the machines to complete the material removal process. The remote operator or automated system, however, may not adequately determine a degree of tool engagement with the pile during loading of material from the pile. For example, the hardness or softness of the material in the pile can affect an amount of penetration of the tool into the pile. As a result, the tool may be under-loaded during a particular loading segment, and too much energy and time may be consumed by attempting to increase loading of the tool.

U.S. Pat. No. 7,555,855 of Alshaer et al. that issued on Jul. 7, 2009 ("the '855 patent") discloses an automatic loading control system for loading a work implement of a machine with material from a pile. In particular, the '855 patent discloses a loading control system that controls the drive torque between the wheels and the ground to account for the toughness of the material pile. The '855 patent also discloses that the loading control system detects a speed of the machine and detects lift and tilt velocities of the lift and tilt actuators, respectively, associated with the work implement. The '855 patent further discloses controlling the drive torque between the wheels and the ground based on at least one of the lift velocity of the lift actuator, the tilt velocity of the tilt actuator, or the speed of the machine. By controlling the drive torque in this manner, the loading control system of the '855 patent aims to apply and maintain an adequate amount of force on the material pile to improve efficiency of the digging and loading process.

Although the loading control system disclosed in the '855 patent discloses controlling an amount of drive torque to apply adequate horizontal force on the material pile to allow the work implement to penetrate the material pile, the disclosed system may nonetheless be improved upon. In particular, although the disclosed system of the '855 patent may help the work implement to penetrate the pile horizontally, the disclosed system may not be able to ensure that the work implement is sufficiently loaded with material in each excavation cycle.

The excavation system of the present disclosure solves one or more of the problems set forth above and/or other problems of the prior art.

SUMMARY

In one aspect, the present disclosure is directed to an excavation system for a machine having a work tool. The excavation system may include a speed sensor configured to generate a first signal indicative of a travel speed of the machine. The excavation system may also include at least one load sensor configured to generate a second signal indicative of loading of the work tool. In addition, the excavation system may include a controller in communication with the speed sensor and the at least one load sensor. The controller may be configured to detect engagement of the work tool with a material pile based on at least one of the first signal and the second signal. The controller may also be configured to select at least one tilt control parameter value for the work tool. Further, the controller may be configured to operate the work tool based on the selected tilt control parameter value to load the work tool with an amount of material. The controller may also be configured to determine whether the amount of material exceeds a target amount. In addition, the controller may be configured to cause the machine to withdraw from the material pile when the amount exceeds the target amount.

In another aspect, the present disclosure is directed to a method of controlling a machine having a work tool. The method may include sensing a first parameter indicative of a travel speed of the mobile machine. The method may also include sensing at least a second parameter indicative of loading of the work tool. The method may further include detecting engagement of the work tool with a material pile based on at least one of the first parameter and the second parameter. The method may include selecting at least one tilt control parameter value for the work tool. The method may further include operating the work tool based on the selected tilt control parameter value to load the work tool with an amount of material. The method may also include determining whether the amount of material exceeds a target amount. In addition, the method may include causing the machine to withdraw from the material pile when the amount exceeds the target amount.

In yet another aspect, the present disclosure is direct to a machine. The machine may include a frame. The machine may also include a plurality of wheels rotatably connected to the frame and configured to support the frame. The machine may further include a power source mounted to the frame and configured to drive the plurality of wheels. The machine may also include a work tool operatively connected to the frame, driven by the power source, and having a tip configured to engage a material pile. Further, the machine may include a speed sensor associated with the plurality of wheels and configured to generate a first signal indicative of a travel speed of the machine. The machine may also include a torque sensor associated with the power source and configured to generate a second signal indicative of a torque output of the power source. In addition, the machine may include an acceleration sensor configured to generate a third signal indicative of an acceleration of the mobile machine. The machine may also include a controller in communication with the speed sensor, the torque sensor, and the acceleration sensor. The controller may be configured to detect engagement of the work tool with the material pile based on at least one of the first, second, and third signals. The controller may also be configured to select at least one tilt control parameter value for the work tool. Further, the controller may be configured to operate the work tool based on the selected tilt control parameter value to load the work tool with an amount of material from the material pile. The controller may also be configured to determine whether the amount of material exceeds a target amount. In addition, the controller may be configured to cause the machine to withdraw from the material pile when the amount exceeds the target amount.

DETAILED DESCRIPTION

Figure 1:
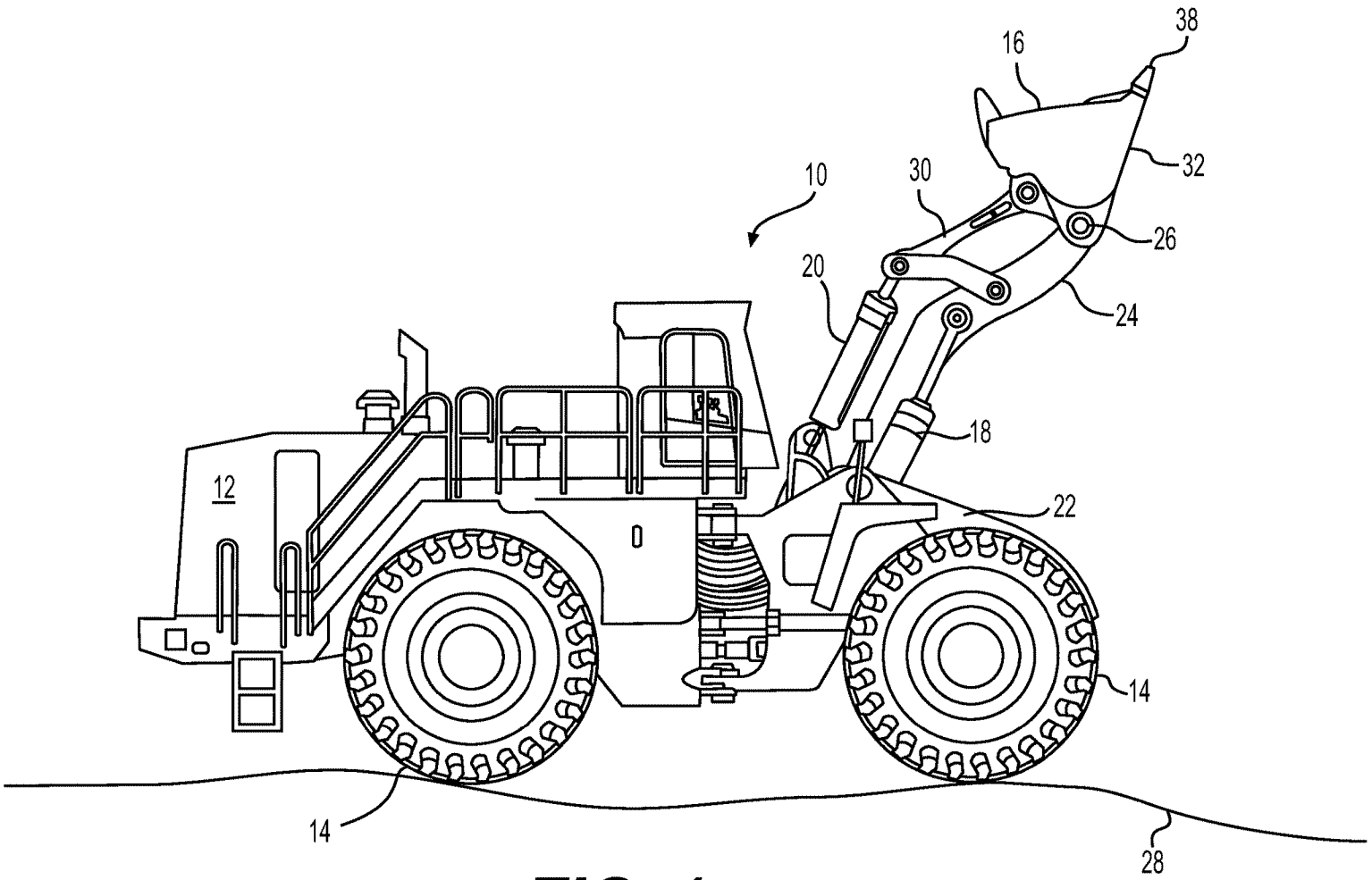
FIG. 1 is a side-view illustration of an exemplary disclosed machine.

FIG. 1 illustrates an exemplary embodiment of a machine 10. In the disclosed example, machine 10 is a load-haul-dump machine (LHD). It is contemplated, however, that machine 10 could embody another type of excavation machine (e.g., a wheel loader or a carry dozer). Machine 10 may include, among other things, a power source 12, one or more traction devices 14 (e.g. wheels), a work tool 16, one or more lift actuators 18, and one or more tilt actuators 20. Lift actuators 18 and tilt actuators 20 may connect work tool 16 to frame 22 of machine 10. In one exemplary embodiment as illustrated in FIG. 1, lift actuators 18 may have one end connected to frame 22 and an opposite end connected to a structural member 24, which may be connected to work tool 16. Work tool 16 may be connected to structural member 24 via pivot pin 26. Lift actuators 18 may be configured to lift or raise work tool 16 to a desired height above ground surface 28. In one exemplary embodiment as illustrated in FIG. 1, tilt actuators 20 may have one end connected to frame 22 and an opposite end connected to linkage member 30, which may be connected to work tool 16. Tilt actuators 20 may be configured to alter an inclination of a lower surface 32 of work tool 16 relative to ground surface 28.

Power source 12 may be supported by a frame 22 of machine 10, and may include an engine (not shown) configured to produce a rotational power output and a transmission (not shown) that converts the power output to a desired ratio of speed and torque. The rotational power output may be used to drive a pump (not shown) that supplies pressurized fluid to lift actuators 18, tilt actuators 20, and/or to one or more motors (not shown) associated with wheels 14. The engine of power source 12 may be a combustion engine configured to burn a mixture of fuel and air, the amount and/or composition of which directly corresponding to the rotational power output. The transmission of power source 12 may take any form known in the art, for example a power shift configuration that provides multiple discrete operating ranges, a continuously variable configuration, or a hybrid configuration. Power source 12, in addition to driving work tool 16, may also function to propel machine 10, for example via one or more traction devices (e.g., wheels) 14.

Numerous different work tools 16 may be operatively attachable to a single machine 10 and driven by power source 12. Work tool 16 may include any device used to perform a particular task such as, for example, a bucket, a fork arrangement, a blade, a shovel, or any other task-performing device known in the art. Although connected in the embodiment of FIG. 1 to lift and tilt relative to machine 10, work tool 16 may alternatively or additionally rotate, slide, swing open/close, or move in any other manner known in the art. Lift and tilt actuators 18, 20 may be extended or retracted to repetitively move work tool 16 during an excavation cycle.

Figure 2:
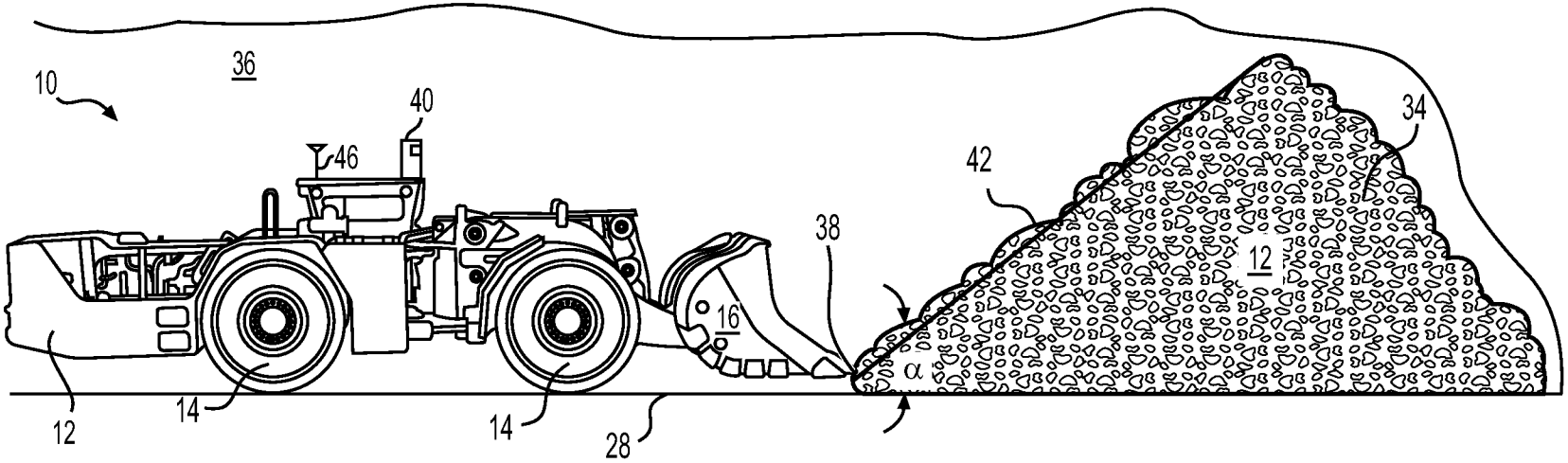
FIG. 2 is a side-view illustration of the machine of FIG. 1 operating at an exemplary disclosed worksite.

In one exemplary embodiment as illustrated in FIG. 2, the excavation cycle may be associated with removing a material pile 34 from inside of a mine tunnel 36. Material pile 34 may constitute a variety of different types of materials. For example, material pile 34 may consist of loose sand, dirt, gravel etc. In other exemplary embodiments, material pile 34 may consist of mining materials, or other tough material such as clay, rocks, mineral formations, etc. In one exemplary embodiment as illustrated in FIG. 2, work tool 16 may be a bucket having a tip 38 configured to penetrate the material pile 34. Machine 10 may also include one or more externally mounted sensors 40 configured to determine a distance of the sensor from pile face 42. Each sensor 40 may be a device, for example a LIDAR (light detection and ranging) device, a RADAR (radio detection and ranging) device, a SONAR (sound navigation and ranging) device, a camera device, or another device known in the art for determining a distance. Sensor 40 may generate a signal corresponding to the distance, direction, size, and/or shape of the object at the height of sensor 40, and communicate the signal to an on-board controller 44 (shown only in FIG. 3) for subsequent conditioning.

Alternatively or additionally, machine 10 may be outfitted with a communication device 46 that allows communication of the sensed information to an off-board entity. For example, excavation machine 10 may communicate with a remote control operator and/or a central facility (not shown) via communication device 46. This communication may include, among other things, the location of material pile 34, properties (e.g., shape) of material pile 34, operational parameters of machine 10, and/or control instructions or feedback.

Figure 3:
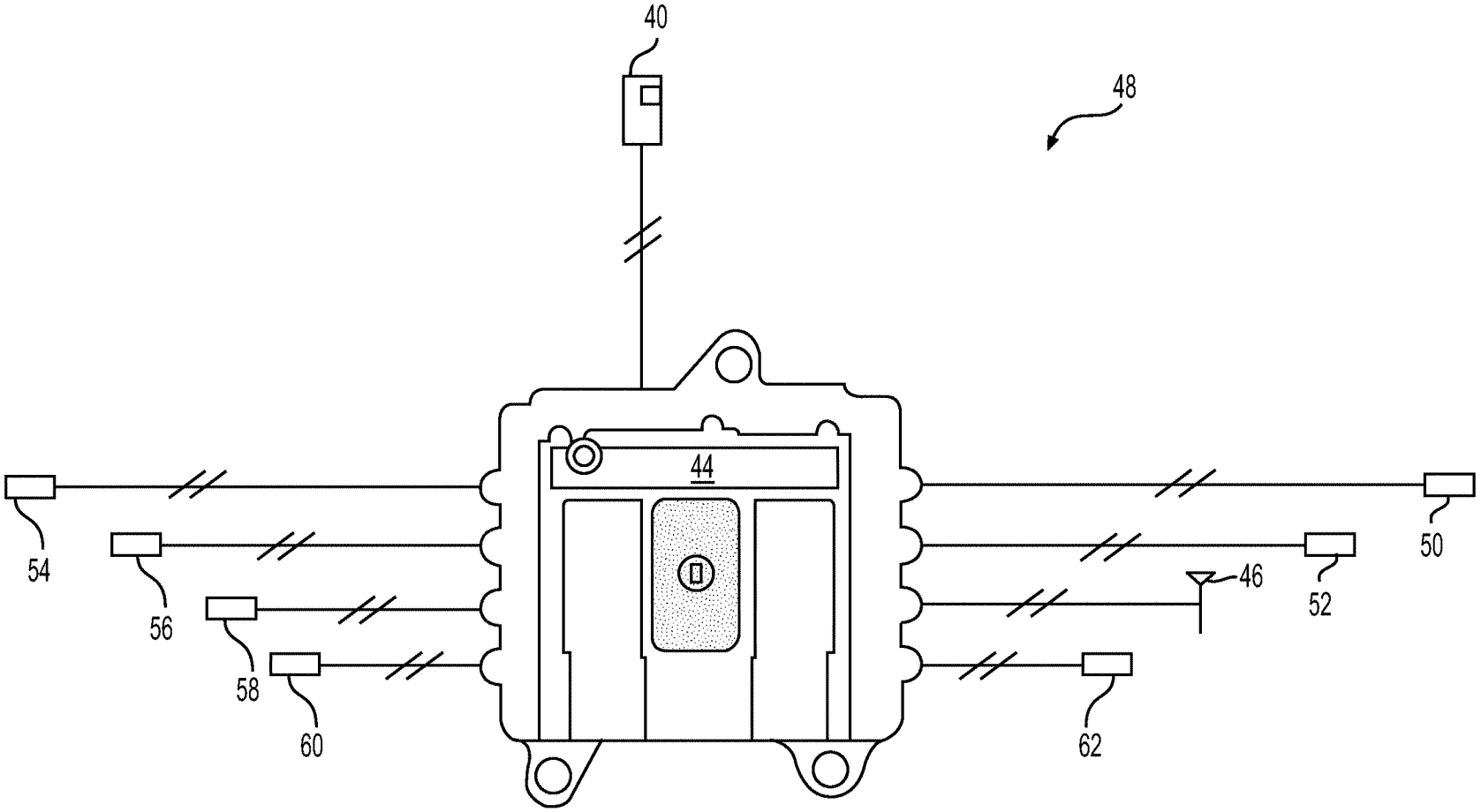
FIG. 3 is a diagrammatic illustration of an exemplary disclosed excavation system that may be used in conjunction with the machine of FIG. 1.

FIG. 3 illustrates an excavation system 48 configured to automatically determine various operational parameters of machine 10 to improve efficiency of machine 10 in an excavation cycle. Excavation system 48 may include, among other things, sensor 40, controller 44, communication device 46, speed sensor 50, at least one load sensor 52, lift sensor 56, tilt sensor 58, lift pressure sensor 60, and tilt pressure sensor 62. Controller 44 may be in communication with each of these sensors and numerous other components of excavation system 48 and, as will be explained in more detail below, configured to detect engagement of work tool 16 (referring to FIG. 2) with material pile 34, to determine a repose angle α of material pile 34, to determine a tip angle β of tip 38, to determine one or more tilt control parameters for work tool 16, etc. This information may be used for remotely or autonomously controlling machine 10, including, among other things, to control operation of work tool 16.

Controller 44 may embody a single microprocessor or multiple microprocessors that include a means for monitoring operations of excavation machine 10, communicating with an off-board entity, and detecting properties of material pile 34. For example, controller 44 may include a memory, a secondary storage device, a clock, and a processor, such as a central processing unit or any other means for accomplishing a task consistent with the present disclosure. The memory or secondary storage device associated with controller 44 may store data and/or routines that may assist controller 44 to perform its functions. Further the memory or storage device associated with controller 44 may also store data received from the various sensors associated with machine 10. Numerous commercially available microprocessors can be configured to perform the functions of controller 44. It should be appreciated that controller 44 could readily embody a general machine controller capable of controlling numerous other machine functions. Various other known circuits may be associated with controller 44, including signal-conditioning circuitry, communication circuitry, hydraulic or other actuation circuitry, and other appropriate circuitry.

Communication device 46 may include hardware and/or software that enable the sending and/or receiving of data messages through a communications link. The communications link may include satellite, cellular, infrared, radio, and/or any other type of wireless communications. Alternatively, the communications link may include electrical, optical, or any other type of wired communications. In one embodiment, on-board controller 44 may be omitted, and an off-board controller (not shown) may communicate directly with sensor 40, speed sensor 50, one or more load sensors 52, lift sensor 56, tilt sensor 58, lift pressure sensor 60, tilt pressure sensor 62, and/or other components of machine 10 via communication device 46.

Speed sensor 50 may embody a conventional rotational speed detector having a stationary element rigidly connected to frame 22 (referring to FIG. 1) that is configured to sense a relative rotational movement of wheel 14 (e.g., of a rotating portion of power source 12 that is operatively connected to wheel 14, such as an axle, a gear, a cam, a hub, a final drive, etc.). The stationary element may be a magnetic or optical element mounted to an axle housing (e.g., to an internal surface of the housing) and configured to detect the rotation of an indexing element (e.g., a toothed tone wheel, an embedded magnet, a calibration stripe, teeth of a timing gear, a cam lobe, etc.) connected to rotate with one or more of wheels 14. The indexing element may be connected to, embedded within, or otherwise form a portion of the front axle assembly that is driven to rotate by power source 12. Speed sensor 50 may be located adjacent the indexing element and configured to generate a signal each time the indexing element (or a portion thereof, for example a tooth) passes near the stationary element. This signal may be directed to controller 44, which may use this signal to determine a distance traveled by machine 10 between signal generation times (i.e., to determine a travel speed of machine 10). Controller 44 may record the traveled distances and/or speed values associated with the signal in a memory or other secondary storage device associated with controller 44. Alternatively or additionally, controller 44 may record a number of wheel rotations, occurring within fixed time intervals, and use this information along with known kinematics of wheel 14 to determine the distance and speed values. Other types of sensors and/or strategies may also or alternatively be employed to determine a travel speed of machine 10.

Load sensor 52 may be any type of sensor known in the art that is capable of generating a load signal indicative of an amount of load exerted on work tool 16, for example by material pile 34 when work tool 16 comes into contact with material pile 34. Load sensor 52 may, for example, be a torque sensor associated with power source 12, or an accelerometer. When load sensor 52 is embodied as a torque sensor, the load signal may correspond with a change in torque output experienced by power source 12 during travel of machine 10. In one exemplary embodiment, the torque sensor may be physically associated with the transmission or final drive of power source 12. In another exemplary embodiment, the torque sensor may be physically associated with the engine of power source 12. In yet another exemplary embodiment, the torque sensor may be a virtual sensor used to calculate the torque output of power source 12 based on one or more other sensed parameters (e.g., fueling of the engine, speed of the engine, and/or the drive ratio of the transmission or final drive). When load sensor 52 is embodied as an accelerometer, the accelerometer may embody a conventional acceleration detector rigidly connected to frame 22 or other components of machine 10 in an orientation that allows sensing of changes in acceleration in the forward and rearward directions for machine 10. It is contemplated that excavation system 48 may include any number and types of load sensors 52.

Lift sensor 56 may embody a magnetic pickup-type sensor associated with a magnet (not shown) embedded within lift actuators 18. In this configuration, lift sensor 56 may be configured to detect an extension position or a length of extension of lift actuator 18 by monitoring the relative location of the magnet, and generate corresponding position and/or lift velocity signals directed to controller 44 for further processing. It is also contemplated that lift sensor 56 may alternatively embody other types of sensors such as, for example, magnetostrictive-type sensors associated with a wave guide (not shown) internal to lift actuator 18, cable type sensors associated with cables (not shown) externally mounted to lift actuator 18, internally- or externally-mounted optical sensors, LIDAR, RADAR, SONAR, or camera type sensors or any other type of height-detection sensors known in the art. From the position and/or velocity signals generated by lift sensor 56 and based on known geometry and/or kinematics of frame 22, lift actuators 18 and tilt actuators 20, and other connecting components of machine 10, controller 44 may be configured to calculate a height of work tool 16 above ground surface 28. In one exemplary embodiment, controller 44 may be configured to calculate a height of lower surface 32 of work tool 16 above ground surface 28. In another exemplary embodiment, controller 44 may be configured to calculate a height of tip 38 of work tool 16 above ground surface 28. In yet another exemplary embodiment, controller 44 may be configured to calculate a height of pivot pin 26 (shown in FIGS. 1 and 2) of work tool 16 above ground surface 28.

Tilt sensor 58 may also embody a magnetic pickup-type sensor associated with a magnet (not shown) embedded within tilt actuator 20. In this configuration, tilt sensor 58 may be configured to detect an extension position or a length of extension of tilt actuator 20 by monitoring the relative location of the magnet, and generate corresponding position and/or tilt velocity signals directed to controller 44 for further processing. From the position and/or tilt velocity signals generated by tilt sensor 58 and based on known geometry and/or kinematics of frame 22, lift actuators 18 and tilt actuators 20, and other connecting components of machine 10, controller 44 may be configured to calculate tip angle "β," representing an angle of inclination of lower surface 32 of work tool 16 relative to ground surface 28. It is also contemplated that controller 44 may be able to use signals generated by one or more tilt sensors 58 to determine a rack angle "$\beta_{rack}$" and/or an unrack angle "$\beta_{unrack}$" of work tool 16. As used in this disclosure, $\beta_{rack}$ refers to a change in the angular position of work tool 16 from its current position as work tool 16 is tilted away from ground surface 28. Likewise, as used in this disclosure, $\beta_{unrack}$ refers to a change in the angular position of work tool 16 from its current position as work tool 16 is tilted towards ground surface 28. It is also contemplated that tilt sensor 58 may alternatively embody other types of sensors such as, for example, magnetostrictive-type sensors associated with a wave guide (not shown) internal to tilt actuator 20, cable type sensors associated with cables (not shown) externally mounted to tilt actuator 20, internally- or externally-mounted optical sensors, rotary style sensors associated with joints pivotable by tilt actuators 20, or any other type of angle-detection sensors known in the art.

One or more lift pressure sensors 60 may be strategically located within the one or more lift actuators 18 to sense a pressure of the fluid within lift actuators 18. Lift pressure sensor 60 may generate a corresponding signal indicative of the pressure within lift actuator 18 and direct the signal to controller 44. Likewise, one or more tilt pressure sensors 62 may be strategically located within the one or more tilt actuators 20 to sense a pressure of the fluid within tilt actuators 20. Tilt pressure sensor 62 may generate a corresponding signal indicative of the pressure within tilt actuator 20 and direct the signal to controller 44. Controller 44 may use the information received from the one or more sensors and components of machine 10 to control operations of machine 10, as will be described in more detail below.

FIGS. 4-8 illustrate exemplary methods that may be performed by excavation system 48. FIGS. 4-8 will be discussed in more detail in the following section to further illustrate the disclosed concepts.

INDUSTRIAL APPLICABILITY

The disclosed excavation system may be used in any machine at a worksite where it is desirable to remotely or autonomously control the machine while ensuring that a work tool of the machine is sufficiently loaded with material. For example, the disclosed excavation system may be used in a LHD, wheel loader, or carry dozer that operates under hazardous conditions. The excavation system may assist control of the machine by automatically detecting tool engagement with a pile of material, responsively determining tilt control parameters for a work tool of the machine, and controlling operation of the work tool to increase an amount of material loaded into the work tool in each excavation cycle regardless of the conditions of the material pile (e.g. toughness, hardness, or moisture content of the material pile). Operation of excavation system 48 will now be described in detail with reference to FIGS. 4-8.

Figure 4:
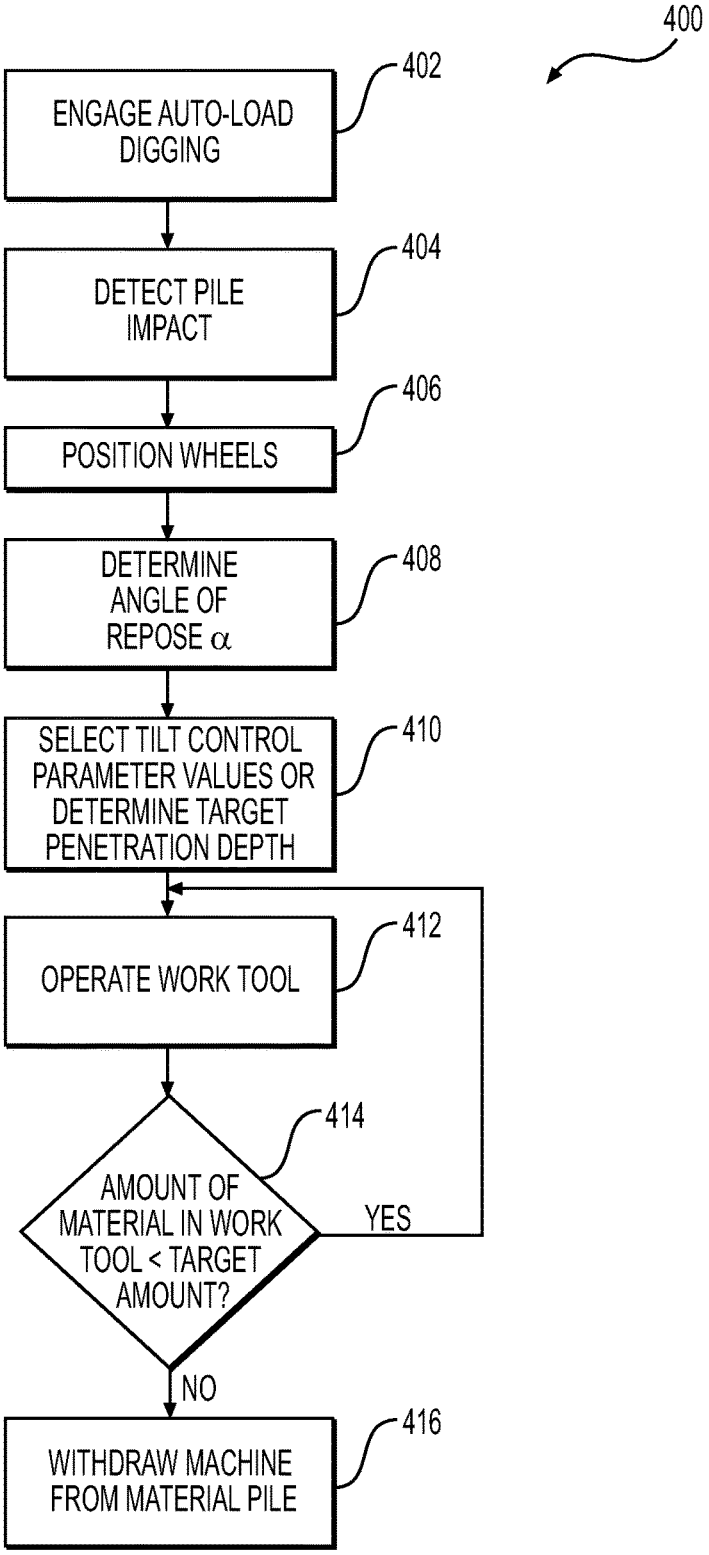
FIG. 4 is a flowchart illustrating an exemplary disclosed method of excavation performed by the excavation system of FIG. 3.

FIG. 4 illustrates an exemplary disclosed method of excavation 400 performed by excavation system 48. Method 400 may include a step of engaging auto-load digging (Step 402) for machine 10 at any time during forward travel of machine 10. The auto-load digging functionality may help ensure that sufficient amount of material is loaded in work tool 16 during each excavation cycle. In step 402, controller 44 may initiate the auto-load digging functionality in response to a variety of inputs. For example, controller 44 may automatically initiate auto-load digging in response to a detection of forward travel (e.g., in response to a signal from speed sensor 50). In another example, controller 44 may initiate auto-load digging in response to a proximity to material pile 34 (e.g., in response to a signal from sensor 40). In yet another example, auto-loading may be initiated manually by a local or remote operator. Any combination of these inputs (and others) may be utilized to initiate auto-load digging functionality.

Method 400 may include a step of detecting pile impact, for example, detecting contact of work tool 16 with material pile 34 (Step 404). In one exemplary embodiment, controller 44 may orient work tool 16 so that lower surface 32 of work tool 16 is disposed generally parallel to ground surface 28. As machine 10 travels towards material pile 34 with work tool 16 disposed generally parallel to ground surface 28, controller may receive signals from various components of machine 10. Controller 44 may detect contact of work tool 16 with material pile 34 based on a sharp change in acceleration of machine 10. Alternatively or additionally, controller 44 may detect a slowing down of machine 10 by detecting a sharp change in torque output of power source 12 (i.e., by an increase in torque output). Accordingly, controller 44 may continuously compare monitored values of torque output and acceleration to respective threshold values to detect engagement of work tool 16 with material pile 34.

Method 400 may include a step of positioning wheels 14 of machine 10 (Step 406). As used in this disclosure, positioning wheels 14 may include setting wheels 14 on ground surface 28 so as to increase an amount of traction (i.e. reduce slip) between wheels 14 and ground surface 28. The process for positioning wheels 14 will be discussed in more detail below with respect to FIG. 5.

Method 400 may include a step of determining an angle of repose "a" (see FIG. 2) of material pile 34 (step 408). As used in this disclosure, angle of repose α may represent an average inclination of pile face 42 of material pile 34 relative to ground surface 28. Controller 44 may receive signals from sensor 40 after detecting contact of work tool 16 with material pile 34. Controller 44 may use the signals from sensor 40 and information regarding geometry of machine 10 to determine angle of repose α.

Method 400 may include a step of selecting one or more tilt control parameter values for work tool 16 or determining a target penetration depth "$D_{target}$." (Step 410). Thus, in one exemplary embodiment, in step 410, controller 44 may select one or more tilt control parameter values (i.e. a first set of tilt control parameter values) based on the angle of repose α. In another exemplary embodiment, in step 410, controller 44 may instead determine a target penetration depth $D_{target}$ based on the angle of repose α. The tilt control parameter values may include among other things, a minimum tilt angle "$\beta_{min}$", maximum tip angle "$\beta_{max}$", a maximum rack angle "$\beta_{rack\text{-}max}$," a maximum unrack angle "$\beta_{unrack\text{-}max}$," a maximum rack time "$T_{rack\text{-}max}$," a maximum unrack time "$T_{unrack\text{-}max}$," a maximum rack velocity "$V_{rack\text{-}max}$," a maximum unrack velocity "$V_{unrack\text{-}max}$," etc. Minimum tilt angle $\beta_{min}$ may represent a minimum value of tip angle β of lower surface 32 relative to ground surface 28 at which work tool 16 must be tilted before tip 38 engages pile face 42. Maximum tilt angle $\beta_{max}$ may represent a maximum value of tip angle $\beta$ of lower surface 32 relative to ground surface 28. Maximum rack angle $\beta_{rack\text{-}max}$ may represent a maximum change in tilt angle $\beta$ as work tool 16 is tilted away from a current position of work tool 16 and away from ground surface 28. Maximum unrack angle $\beta_{unrack\text{-}max}$ may represent a maximum change in tilt angle $\beta$ as work tool 16 is tilted from a current position of work tool 16 toward ground surface 28. Maximum rack time $T_{rack\text{-}max}$ may represent a maximum amount of time in which work tool 16 must be racked by angle $\beta_{rack}$. Maximum unrack time $T_{unrack\text{-}max}$ may represent a maximum amount of time in which work tool 16 must be unracked by angle $\beta_{unrack}$. Maximum rack and unrack velocities ($V_{rack\text{-}max}$, $V_{unrack\text{-}max}$) may represent the maximum rates of change of tip angle $\beta$ with time when work tool 16 is being racked or unracked, respectively. Thus, for example, in step 410, controller 44 may select a value for at least one tilt control parameter from among $\beta_{min}$, $\beta_{max}$, $\beta_{rack\text{-}max}$, $\beta_{unrack\text{-}max}$, $T_{rack\text{-}max}$, $T_{unrack\text{-}max}$, $V_{rack\text{-}max}$, and $V_{unrack\text{-}max}$. It is contemplated that controller 44 may select values for more than one tilt control parameter. Further details regarding selecting tilt control parameter values based on angle of repose $\alpha$ will be discussed below with respect to FIG. 6. Likewise, further details regarding determining target penetration depth $D_{target}$ based on angle of repose $\alpha$ will be discussed below with respect to FIG. 7.

Method 400 may include a step of operating work tool 16 based on the selected one or more tilt control parameter values (Step 412) to load work tool 16 with material from material pile 34. Operating work tool 16 may include repeatedly racking and unracking work tool 16. Further details regarding operating work tool 16 will be discussed below with respect to FIGS. 7 and 8. Work tool 16 may penetrate material pile 34 and fill up with material from material pile 34 as work tool 16 is racked and unracked in step 412. Method 400 may include a step of determining whether an amount of material in work tool 16 is less than a target amount (Step 414). When controller 44 determines that the amount of material in work tool 16 is less than the target amount (Step 414: Yes), controller 44 may return to step 412 to continue to operate work tool 16 by racking and unracking work tool 16. When controller 44 determines that the amount of material in work tool 16 is equal to or more than the target amount (Step 414: No), controller 44 may proceed to step 416. In step 416, controller 44 may issue commands to cause machine 10 to withdraw from material pile 34. After withdrawing from material pile 34, machine 10 may travel to a dump location to dump the amount of material present in work tool 16.

Figure 5:
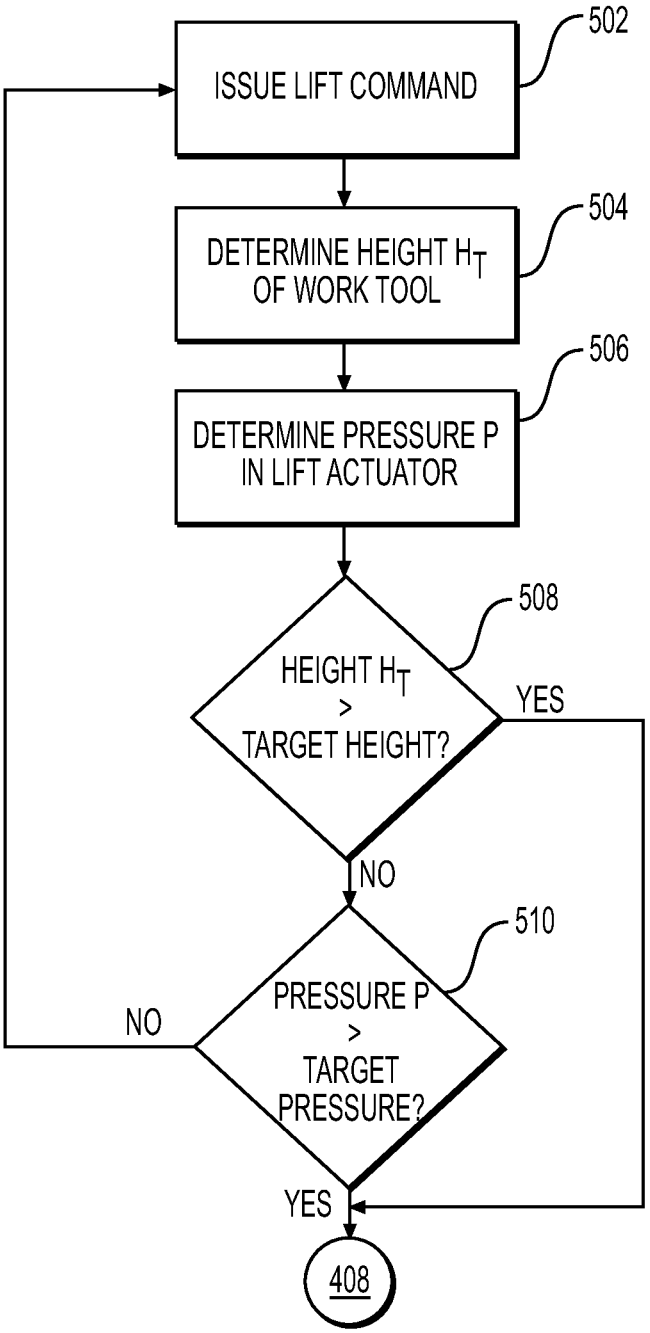
FIG. 5 is a flowchart illustrating an exemplary disclosed method of positioning the wheels of the machine of FIG. 1.

FIG. 5 illustrates an exemplary method 500 that may be used by excavation system 48 to position wheels 14 of machine 10, for example, as discussed in step 406 of method 400. As illustrated in FIG. 5, controller 44 may issue a lift command to the one or more lift actuators 18 associated with work tool 16 to lift (i.e. raise) work tool 16 above ground surface 28 (Step 502). Controller 44 may determine a height "$H_T$" of work tool 16 above ground surface 28 using, among other things, signals from lift sensor 56 (Step 504). Controller 44 may also determine a pressure "P" within lift actuator 18 using signals from lift pressure sensor 60 (Step 506). Controller 44 may compare the height $H_T$ of work tool 16 to a target height value to determine whether the height $H_T$ of work tool 16 exceeds the target height. (Step 508). When controller 44 determines that the height $H_T$ of work tool 16 is greater than the target height (Step 508: Yes), controller 44 may exit process 500 and proceed to, for example, step 408 of method 400. When controller 44 determines, however, that the height $H_T$ of work tool 16 is less than or equal to the target height (Step 508: No), controller 44 may proceed to step 510 of determining whether lift pressure P exceeds a target lift pressure (Step 510). When controller 44 determines that the lift pressure P exceeds the target lift pressure (Step 510: Yes), controller 44 may exit process 500 and proceed to, for example, step 408 of method 400. When controller 44 determines, however, that the lift pressure P is less than the target lift pressure (Step 510: No), controller 44 may return to step 502 to issue a lift command to further raise the height of work tool 16 above ground surface 28. By raising work tool 16 away from ground surface 28 and transferring the weight of work tool 16 through wheels 14 to ground surface 28 in this manner, controller 44 may help ensure that wheels 14 are set on ground surface 28. Positioning wheels 14 on ground surface 28 in this manner may help ensure that there is sufficient traction between wheels 14 and ground surface 28 during operation of machine 10.

Figure 6:
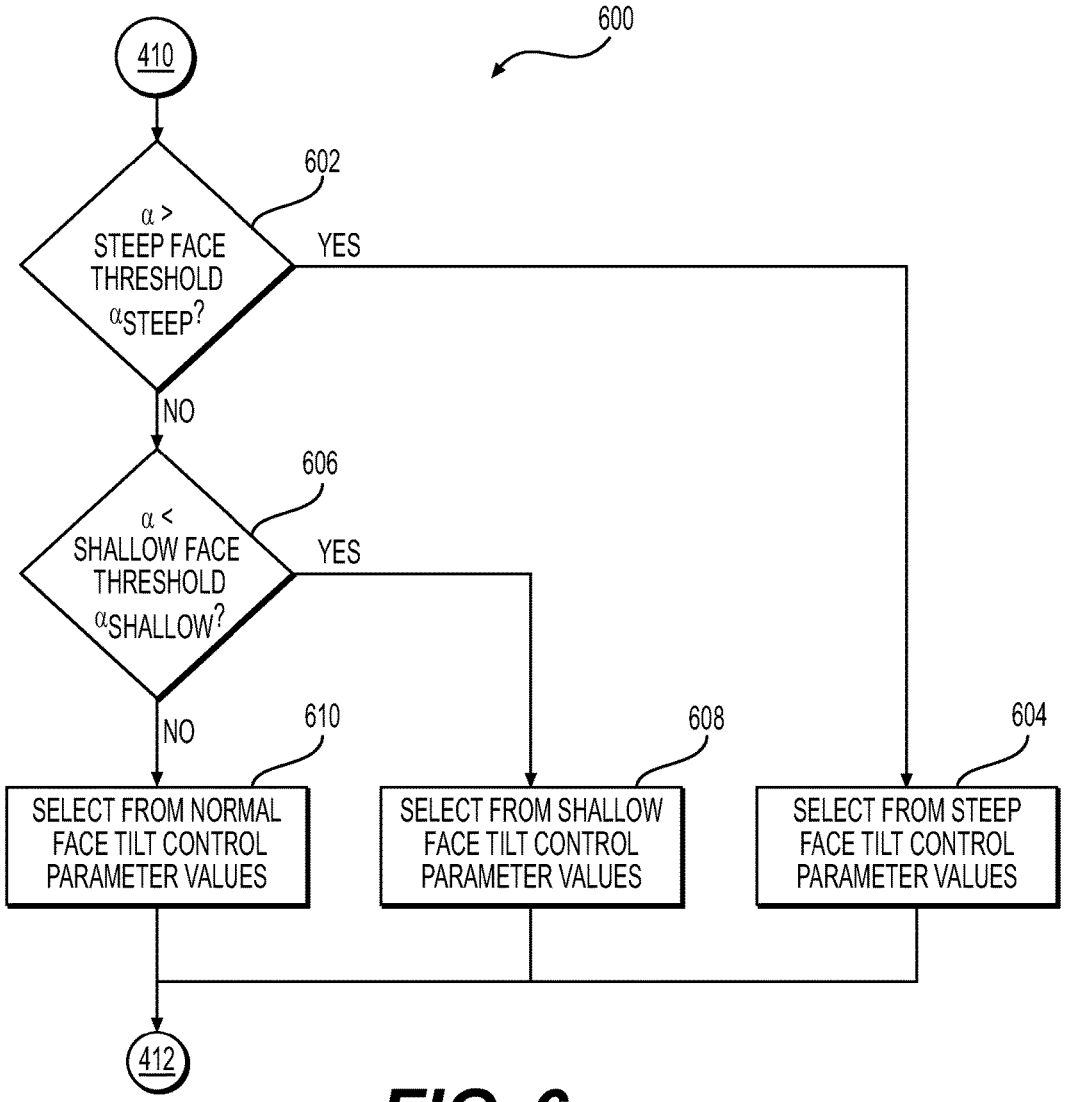
FIG. 6 is a flowchart illustrating an exemplary disclosed method of selecting a first set of tilt control parameters by the excavation system of FIG. 3.

FIG. 6 illustrates an exemplary method 600 that may be used by excavation system 48 to select a set of tilt control parameter values based on the angle of repose $\alpha$. In one exemplary embodiment, controller 44 may execute method 600, for example, when selecting tilt control parameter values in step 410 of method 400. Method 600 may include a step of determining whether angle of repose $\alpha$ exceeds a steep face threshold angle "$\alpha_{steep}$" (Step 602). The steep face threshold value $\alpha_{steep}$ may be used by controller 44 to determine whether an inclination of pile face 42 is steep relative to ground surface 28. In one exemplary embodiment, the steep face threshold angle $\alpha_{steep}$ may be about 50°. It is contemplated, however that $\alpha_{steep}$ may have other values different from about 50°. As used in this disclosure the term "about" refers to typical variations in measurement. Thus, for example with respect to angles, about equal may imply equality when two angles are within ±0.1°. Likewise, for example, with respect to times, about equal may imply equality when two time durations are with ±1 millisecond. With respect to distances or lengths, for example, about equal may imply equality when two distances or lengths are within ±1 mm. And, with respect to velocities, for example, about equal may imply equality when two velocities are within ±0.1 m/s.

When controller 44 determines that angle of repose $\alpha$ exceeds steep face threshold angle $\alpha_{steep}$ (Step 602: Yes), controller 44 may proceed to a step of selecting the one or more tilt control values from steep face tilt control parameter values (Step 604). When controller 44 determines, however, that angle of repose $\alpha$ is less than or equal to steep face threshold angle $\alpha_{steep}$ (Step 602: No), controller 44 may proceed to a step of determining whether angle of repose $\alpha$ is less than a shallow face threshold angle "$\alpha_{shallow}$" (Step 606). The shallow face threshold value $\alpha_{shallow}$ may be used by controller 44 to determine whether an inclination of pile face 42 is shallow relative to ground surface 28. In one exemplary embodiment the shallow face threshold angle $\alpha_{shallow}$ may be about 25°. It is contemplated, however that $\alpha_{shallow}$ may have other values different from about 25°. When controller 44 determines that angle of repose $\alpha$ is less than the shallow face threshold angle $\alpha_{shallow}$ (Step 606: Yes), controller 44 may proceed to a step of selecting one or more tilt control parameter values from shallow face tilt control parameter values. When controller 44 determines, however, that angle of repose $\alpha$ is greater than or equal to the shallow face threshold angle $\alpha_{shallow}$ (Step 606: No), controller 44 may proceed to a step of selecting one or more tilt control parameter values from normal face tilt control parameter values. After selecting the one or more tilt control parameter values in steps 604, 608, or 610, controller 44 may proceed to, for example, step 412 of method 400.

As discussed above, when angle of repose $\alpha$ exceeds steep face threshold angle $\alpha_{steep}$, controller 44 may select one or more tilt control parameter values from a set of steep face tilt control parameter values. A skilled artisan would recognize that when $\alpha$ exceeds $\alpha_{steep}$, pile face 42 of material pile 34 may be inclined at a relatively steep angle relative to ground surface 28. The skilled artisan may further recognize that in such a situation, tilting the work tool 16 too little relative to ground surface 28 may make it harder for work tool 16 to penetrate pile face 42 of material pile 34. To address such situations, the steep face tilt control parameter values may therefore include relatively high values of tip angles $\beta_{min}$ and $\beta_{max}$. In one exemplary embodiment $\beta_{min}$ may be about 45° and $\beta_{max}$ may be about 55°. Likewise, when an inclination of pile face 42 of material pile 34 is steep, selecting a relatively large rack angle $\beta_{rack\text{-}max}$ may cause tip 38 of work tool 16 to loose contact with material pile 34. Additionally, selecting a relatively large unrack angle $\beta_{unrack\text{-}max}$ may make it harder for tip 38 of work tool 16 to penetrate material pile 34. Thus relatively lower values of $\beta_{rack\text{-}max}$ and $\beta_{unrack\text{-}max}$ may be selected. In one exemplary embodiment the values of $\beta_{rack\text{-}max}$ and $\beta_{unrack\text{-}max}$ may range between 0.5° and 1.0°. When the inclination of pile face 42 of material pile 34 is steep, selecting relatively large value of $T_{rack\text{-}max}$ may allow tip 38 of work tool 16 to loose contact with material pile 34 by allowing work tool 16 to rack for a long period time. Similarly selecting a large value for $T_{unrack\text{-}max}$ may make it harder for work tool 16 to penetrate material pile 34 by allowing work tool 16 to unrack for a long period of time. Thus relatively lower values of $T_{rack\text{-}max}$ and $T_{unrack\text{-}max}$ may be selected. In one exemplary embodiment, the values of $T_{rack\text{-}max}$ and $T_{unrack\text{-}max}$ may range between about 0.2 seconds and 0.6 seconds.

As also discussed above, when angle of repose $\alpha$ is less than shallow face threshold angle $\alpha_{shallow}$, controller 44 may select one or more tilt control parameters from a set of shallow face tilt control parameter values. A skilled artisan would recognize that when $\alpha$ is less than $\alpha_{shallow}$, pile face 42 of material pile 34 may be expected to have a relatively shallow inclination relative to ground surface 28. The skilled artisan may further recognize that in such a situation, tilting the work tool 16 too much relative to ground surface 28 may prevent work tool 16 from penetrating pile face 42 of material pile 34. In this case, the shallow face tilt control parameter values may therefore include relatively low values of tip angles $\beta_{min}$ and $\beta_{max}$. In one exemplary embodiment $\beta_{min}$ may be about 0° and $\beta_{max}$ may be about 30°. Likewise, when an inclination of pile face 42 of material pile 34 is shallow, selecting a relatively large rack angle $\beta_{rack\text{-}max}$ may help tip 38 of work tool 16 to move within and penetrate material pile 34. Similarly, when the inclination of pile face 42 of material pile 34 is shallow, selecting a relatively large unrack angle $\beta_{unrack\text{-}max}$ may also help tip 38 of work tool 16 to penetrate material pile 34. Thus relatively higher values of $\beta_{rack\text{-}max}$ and $\beta_{unrack\text{-}max}$ may be selected. In one exemplary embodiment, the values of $\beta_{rack\text{-}max}$ and $\beta_{unrack\text{-}max}$ may range between 1.0° and 2.0°. When the inclination of pile face 42 of material pile 34 is shallow, selecting a relatively large value of $T_{rack\text{-}max}$ may allow tip 38 of work tool 16 to penetrate deeper into material pile 34 by allowing work tool 16 to rack for a long time. Similarly, selecting a relatively large value for $T_{unrack\text{-}max}$ may help work tool 16 to penetrate deeper into material pile 34 by allowing work tool 16 to unrack for a long time. Thus, relatively larger values of $T_{rack\text{-}max}$ and $T_{unrack\text{-}max}$ may be selected. In one exemplary embodiment, the values of $T_{rack\text{-}max}$ and $T_{unrack\text{-}max}$ may range between about 1.0 second and 2.0 seconds. Although only certain tilt control parameters such as $\beta_{min}$, $\beta_{max}$, $\beta_{rack\text{-}max}$, $\beta_{unrack\text{-}max}$, $T_{rack\text{-}max}$, and $T_{unrack\text{-}max}$ have been discussed above, values of other tilt control parameters such $V_{rack\text{-}max}$ and $V_{unrack\text{-}max}$ may also be selected based on the angle of repose $\alpha$.

Figure 7:
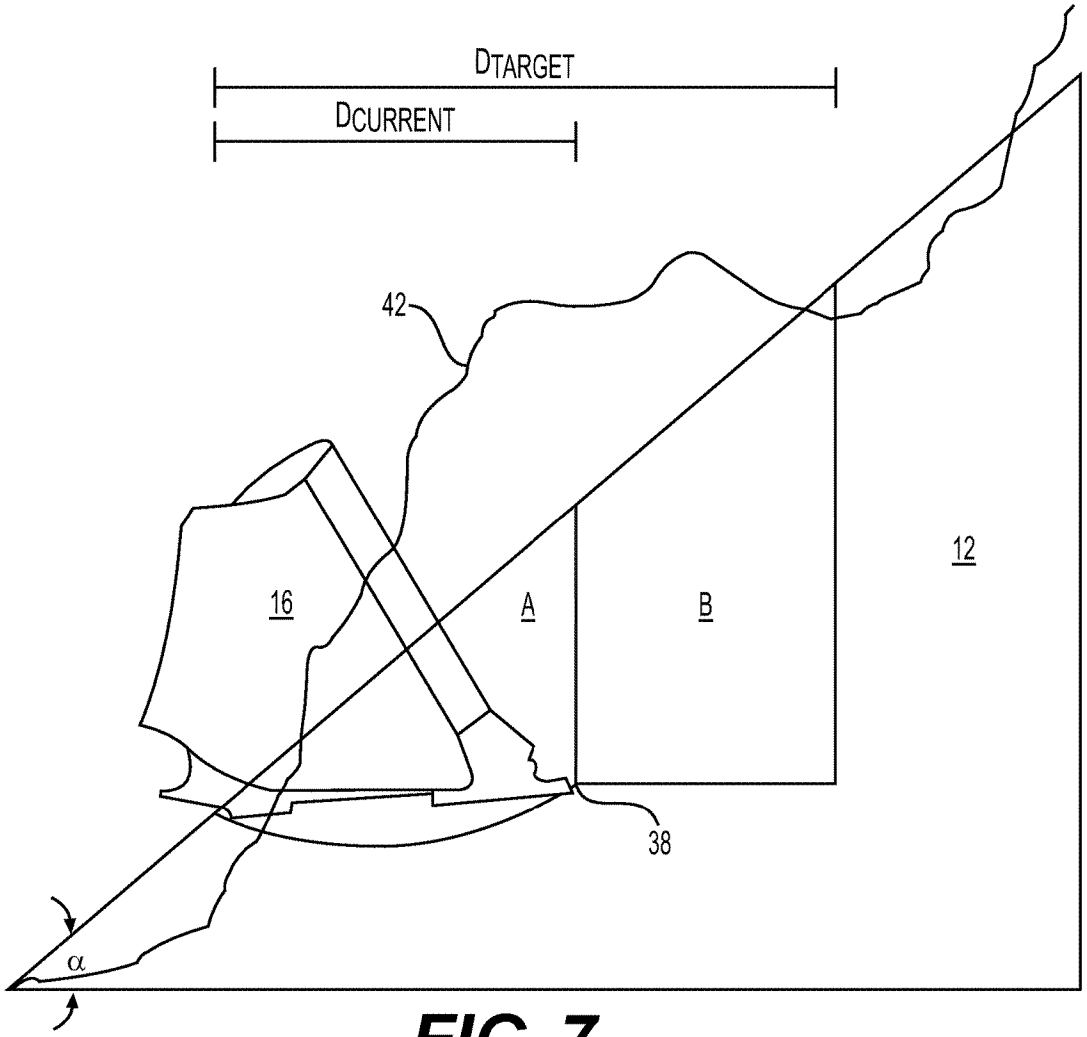
FIG. 7 is a diagrammatic illustration showing the determination of a target penetration depth performed by the excavation system of FIG. 3.

FIG. 7 shows a diagrammatic view of material pile 34 to illustrate the determination of a target penetration depth by controller 44 in, for example, step 410 of method 400. In step 410, controller 44 may determine a position of tip 38 relative to pile face 42. Controller 44 may determine the position of tip 38 based on a current position of machine 10, and signals received from one or more of sensor 40, lift actuators 18, tilt actuators 20, and information regarding the geometry and kinematics of machine 10. Controller 44 may also determine a current penetration distance "$D_{current}$" As used in this disclosure, and as illustrated in FIG. 7, $D_{current}$ represents a generally horizontal distance of tip 38 from pile face 42. Controller 44 may determine $D_{current}$ based on a current position of machine 10, and signals received from one or more of sensor 40, lift actuators 18, tilt actuators 20, and information regarding the geometry and kinematics of machine 10. Controller 44 may then determine a volume of material "A" that work tool 16 may be able to load based on a known or estimated trajectory of tip 38 and angle of repose $\alpha$. Controller 44 may determine an empty volume in work tool 16 based on a known volume of work tool 16 and the volume of material A. The known volume of work tool 16 may be predetermined based on a size of work tool 16 and may be stored in a memory or secondary storage device associated with controller 44. Controller 44 may compute a target penetration distance "$D_{target}$" based on the determined empty volume and angle of repose $\alpha$. In one exemplary embodiment as illustrated in FIG. 7, controller may determine $D_{target}$ such that a volume B may be about equal to the empty volume of work tool 16. Controller 44 may use a variety of mathematical expressions and/or algorithms known in the art to estimate $D_{target}$ so that volume B may be about equal to the empty volume of work tool 16. It is also contemplated that controller 44 may repeatedly determine $D_{target}$ after a predetermined amount of time as controller 44 operates work tool 16 to load work tool 16. In one exemplary embodiment, controller 44 may determine a value of $D_{target}$ after about every 10 milliseconds. In another exemplary embodiment, the target penetration depth may range from about 1.0 to 1.5 m.

Figure 8:
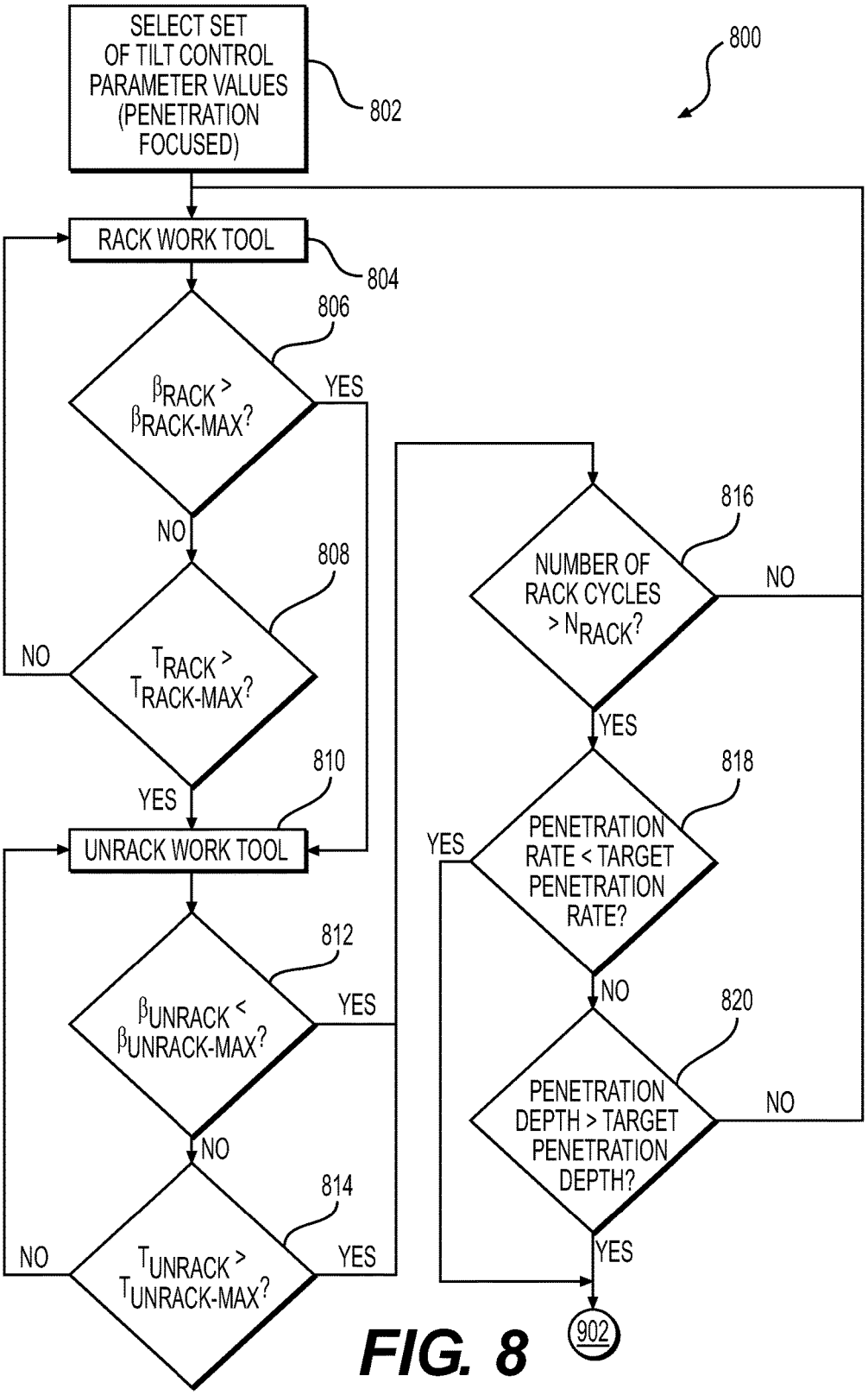
FIG. 8 is a flowchart illustrating an exemplary disclosed method of penetration focused excavation performed by the excavation system of FIG. 3.

FIG. 8 illustrates an exemplary disclosed method 800 performed by excavation system 48 for penetration focused digging. Excavation system 48 may perform method 800, for example, when executing step 412 of method 400. Method 800 may include a step of selecting a set of tilt control parameter values that are penetration focused (Step 802). In one exemplary embodiment, when controller 44 has previously selected a first set of tilt control parameter values in step 410 of method 400, controller 44 may select a second set of tilt control parameter values from the first set of tilt control parameter values. In another exemplary embodiment, when controller 44 determines a target penetration depth $D_{target}$ in step 410 of method 400, controller 44 may select a first set of tilt control parameter values in step 802 that are penetration focused from values stored in a memory or secondary storage device associated with controller 44. The penetration focused tilt control parameter values may help work tool 16 to penetrate material pile 34 in a forward travel direction of machine 10. Selecting the second set of tilt control parameter values may include selecting values of $\beta_{min}$, $\beta_{max}$, $\beta_{rack\text{-}max}$, $\beta_{unrack\text{-}max}$, $T_{rack\text{-}max}$, $T_{unrack\text{-}max}$, $V_{rack\text{-}max}$, and $V_{unrack\text{-}max}$ that may promote penetration of the material pile 34 in a travel direction of machine 10 by work tool 16. Thus for example, controller 44 may further refine the values of $\beta_{min}$, $\beta_{max}$, $\beta_{rack\text{-}max}$, $\beta_{unrack\text{-}max}$, $T_{rack\text{-}max}$, $T_{unrack\text{-}max}$, $V_{rack\text{-}max}$ and $V_{unrack\text{-}max}$ selected in one of steps 604, 608, and 610 of method 600 to help increase a penetration depth of work tool 16 into the material pile 34.

Method 800 may include a step of racking the work tool 16 (Step 804). In step 804, controller 44 may issue a command to tilt actuator 20 to rack work tool 16 to move lower surface 32 of work tool 16 away from ground surface 28. Controller may rack work tool 16 in small tilt angle increments. For example, controller 44 may rack work tool 16 in step 804 in tilt angle increments of about 0.3° to 0.5°.

After racking work tool 16, controller 44 may proceed to step 806 to determine whether a rack angle $\beta_{rack}$ exceeds a threshold rack angle $\beta_{rack\text{-}max}$ (Step 806), where $\beta_{rack\text{-}max}$ may be one of the tilt control parameter values selected in, for example, step 802. Rack angle $\beta_{rack}$ may be an angle measured from a position of lower surface 32 when controller 44 first initiates racking in step 804. In one exemplary embodiment, the threshold rack angle $\beta_{rack\text{-}max}$ may range from about 3.0° to 5.0°. When controller 44 determines that the rack angle $\beta_{rack}$ exceeds the threshold rack angle $\beta_{rack\text{-}max}$ (Step 806: Yes), controller 44 may proceed to step 810. When controller 44 determines, however, that rack angle $\beta_{rack}$ is less than the threshold rack angle $\beta_{rack\text{-}max}$ (Step 806: No), controller 44 may proceed to step 808 to determine whether rack time "$T_{rack}$" exceeds threshold rack time $T_{rack\text{-}max}$. As used in this disclosure time $T_{rack}$, the time during which by work tool 16 is racked, may be measured from the time when controller 44 first initiates racking of work tool 16 in step 804. In one exemplary embodiment, the threshold rack time $T_{rack\text{-}max}$ may range from about 0.5 to 1.0 seconds. In step 808, when controller 44 determines that time $T_{rack}$ exceeds threshold rack time $T_{rack\text{-}max}$ (Step 808: Yes), controller 44 may proceed to step 810. When controller 44 determines, however, that time $T_{rack}$ is less than the threshold rack time $T_{rack\text{-}max}$ (Step 808: No), controller 44 may return to step 804 to further increment rack angle $\beta_{rack}$ of work tool 16. Thus, controller 44 may cycle through one or more of steps 804-808 until either $\beta_{rack}$ exceeds $\beta_{rack\text{-}max}$ or until $T_{rack}$ exceeds $T_{rack\text{-}max}$.

Method 800 may include a step of unracking work tool 16 (Step 810). In step 810, controller 44 may issue a command to tilt actuator 20 to tilt or incline work tool 16 to move lower surface 32 of work tool 16 towards ground surface 28. Controller may unrack work tool 16 in small unrack angle increments. For example, controller 44 may unrack work tool 16 in step 810 in unrack angle increments of about −0.3° to −0.5°.

After unracking work tool 16, controller 44 may proceed to a step of determining whether unrack angle $\beta_{unrack}$ is less than a threshold unrack angle $\beta_{unrack\text{-}max}$ (Step 812), where $\beta_{unrack\text{-}max}$ may be one of the tilt control parameter values selected in, for example, step 802. Unrack angle $\beta_{unrack}$ may be an angle measured from a position of lower surface 32 when controller 44 first initiates unracking in step 810. In one exemplary embodiment, threshold unrack angle $\beta_{unrack\text{-}max}$ may range from about −1.0° to −2.0°. When controller 44 determines that unrack angle $\beta_{unrack}$ is less than threshold unrack angle $\beta_{unrack\text{-}max}$ (Step 812: Yes), controller 44 may proceed to step 816. When controller 44 determines, however, that unrack angle $\beta_{unrack}$ is not less than threshold unrack angle $\beta_{unrack\text{-}max}$ (Step 812: No), controller 44 may proceed to step 814 to determine whether unrack time "$T_{unrack}$" exceeds a threshold unrack time $T_{unrack\text{-}max}$. As used in this disclosure time $T_{unrack}$, the time during which work tool 16 is unracked may be measured from the time when controller 44 first initiates unracking of work tool 16 in step 810. In one exemplary embodiment, threshold unrack time $T_{unrack\text{-}max}$ may range from about 1.0 to 1.5 second. In step 814, when controller 44 determines that time $T_{unrack}$ exceeds threshold unrack time $T_{unrack\text{-}max}$ (Step 814: Yes), controller 44 may proceed to step 816. When controller 44 determines, however, that time $T_{unrack}$ is less than the threshold unrack time $T_{unrack\text{-}max}$ (Step 814: No), controller 44 may return to step 810, to further decrement the tilt angle β of work tool 16. Thus, controller 44 may cycle through one or more of steps 810-814 until either $\beta_{unrack}$ is less than $\beta_{unrack\text{-}max}$ or until $T_{unrack}$ exceeds $T_{unrack\text{-}max}$.

Method 800 may include a step 816 of determining whether a number of rack cycles has exceeded a rack cycle threshold "$N_{rack}$" (Step 816). As used in this disclosure the term rack cycle refers to a complete cycle including a racking and an unracking of work tool 16. In one exemplary embodiment, $N_{rack}$ may range from 3 to 5. When controller 44 determines that the number of rack cycles has exceeded the rack cycle threshold $N_{rack}$ (Step 816: Yes), controller 44 may proceed to step 818. When controller 44 determines, however, that the number of rack cycles has not exceeded the rack cycle threshold $N_{rack}$ (Step 816: No), controller 44 may proceed to step 804 to perform one or more additional rack/unrack cycles.

Method 800 may include a step of determining whether a penetration rate is less than a target penetration rate (Step 818). To determine penetration rate, controller 44 may determine a penetration distance based on an amount of forward travel of machine 10 during execution of method 800. Alternatively or additionally, controller 44 may determine the penetration distance by computing a distance by which tip 38 of work tool 16 moves in a travel direction of machine 10 into material pile 34 during execution of method 800. Controller 44 may determine the penetration distance using a current position of machine 10, information regarding the kinematics of machine 10, and information obtained from sensor 40, lift sensor 56, and/or speed sensor 50. Controller 44 may also determine an amount of time required for tip 38 of work tool 16 to move by the determined penetration distance. Controller 44 may use the penetration distance and the time to determine the penetration rate. Alternatively or additionally, controller 44 may determine the penetration rate using a speed of machine 10. In some exemplary embodiments, controller 44 may also determine the penetration rate as an amount by which tip 38 penetrates material pile 34 in each rack/unrack cycle. When controller 44 determines that the penetration rate is less than the target penetration rate (Step 818: Yes), controller 44 may exit process 800 and proceed to, for example, step 902, which will be discussed below. When controller 44 determines, however, that the penetration rate is not less than the target penetration rate (Step 818: No), controller 44 may proceed to step 820.

Method 800 may include a step of determining whether the penetration depth is less than a target penetration depth (Step 820). As discussed above with respect to FIG. 7, controller 44 may determine the target penetration depth $D_{target}$ in step 820. It is also contemplated that controller 44 may determine the target penetration depth $D_{target}$ periodically while executing various steps of method 800 or between the various steps of method 800. By estimating $D_{target}$ periodically in this manner, controller 44 may help ensure that the most updated value of $D_{target}$ may be available in step 820. When controller 44 determines that the penetration depth has exceeded the target penetration depth (Step 820: Yes), controller 44 may exit process 800 and proceed to, for example, step 902, which will be discussed below. When controller 44 determines, however, that the penetration depth is less than the target penetration depth (Step 820: No), controller 44 may proceed to step 804 to perform additional rack/unrack cycles. By repeatedly racking and unracking work tool 16 in this manner, controller 44 may ensure that work tool 16 penetrates the material pile 34 to a desired penetration depth. Further, by selecting tilt control parameter values based on both the angle of repose $\alpha$ and further by using penetration focused tilt control parameter values, controller 44 may help ensure that work tool 16 penetrates the material pile 34 to a desired penetration depth. This in turn may ensure that work tool 16 may be able to scoop up a desired amount of material in each excavation cycle to improve an efficiency of operation of machine 10. When controller 44 determines that the penetration rate is less than a target penetration rate, for example, because of hardness or toughness of material pile 34, controller 44 may execute method 900 of face cut focused digging.

Figure 9:
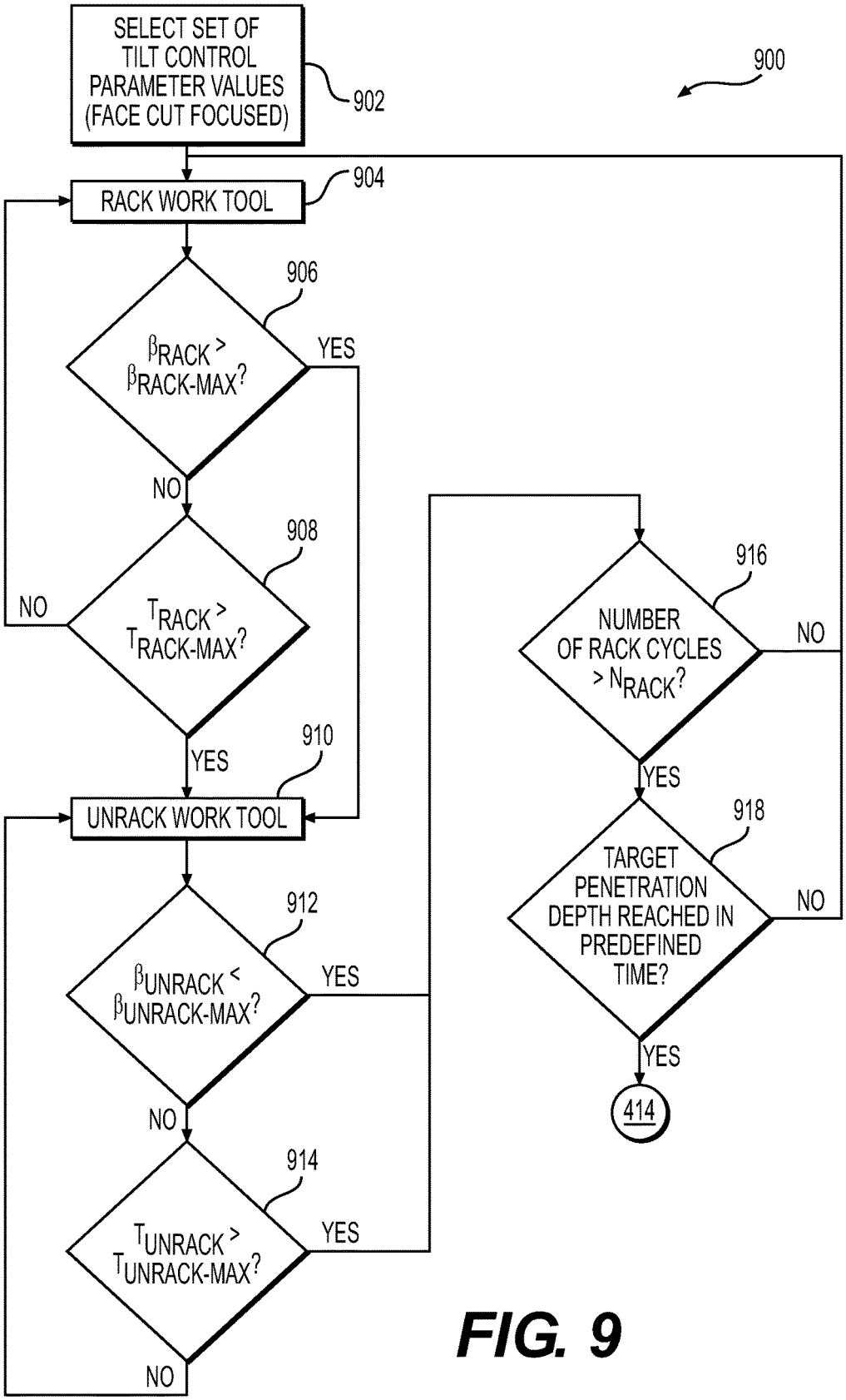
FIG. 9 is a flowchart illustrating an exemplary disclosed method of face cut focused excavation performed by the excavation system of FIG. 3.

FIG. 9 illustrates an exemplary disclosed method 900 performed by excavation system 48 for face cut focused digging. Method 900 may include a step of selecting a set of tilt control parameter values that are face cut focused (Step 902). In one exemplary embodiment, when controller 44 has previously selected a first set of tilt control parameter values in step 410 of method 400, controller 44 may select a third set of tilt control parameter values in step 902 from the first set of tilt control parameter values selected in step 410. In another exemplary embodiment, when controller 44 has previously determined a target penetration depth Dtarget in step 410 of method 400, controller 44 may select a set of tilt control parameter values that are face cut focused from values stored in a memory or secondary storage device associated with controller 44.

For example, in step 902, controller 44 may select the third set of tilt control parameter values from the first set of tilt control parameter values selected, for example, in method 600. The face cut focused tilt control parameter values may help work tool 16 to remove material from pile face 42 of material pile 34 more efficiently. Selecting the third set of tilt control parameter values may include selecting values of $\beta_{min}$, $\beta_{max}$, $\beta_{rack\text{-}max}$, $\beta_{unrack\text{-}max}$, $T_{rack\text{-}max}$, $T_{unrack\text{-}max}$, $V_{rack\text{-}max}$, and $V_{unrack\text{-}max}$ that may promote penetration of work tool 16 into material pile 34 generally parallel to pile face 42. Thus for example, controller 44 may further refine the values of $\beta_{min}$, $\beta_{max}$, $\beta_{rack\text{-}max}$, $\beta_{unrack\text{-}max}$, $T_{rack\text{-}max}$, $T_{unrack\text{-}max}$, $V_{rack\text{-}max}$, and $V_{unrack\text{-}max}$ selected in one of steps 604, 608, and 610 of method 600 to help increase removal of material from pile face 42 of material pile 34.

Method 900 may include steps 904 to 916. When executing steps 904 to 916, controller 44 may perform processes similar to those described above with respect to steps 804 to 816, respectively. The threshold values used in steps 906, 908, 912, and 914 may be the same as or different from the threshold values used in steps 806, 808, 812, and 814, respectively. In one exemplary embodiment, threshold rack time $T_{rack\text{-}max}$ in step 908 may range from about 1.2 to 1.5 seconds. In another exemplary embodiment threshold unrack time $T_{unrack\text{-}max}$ in step 914 may range from about 0.3 to 0.5 second.

Method 900 may also include a step 918 of determining whether the target penetration depth $D_{target}$ has been reached in a predefined time "$T_{penetration}$" (Step 918). As discussed above with respect to FIG. 7, controller 44 may determine the target penetration depth $D_{target}$ in step 918. It is also contemplated that controller 44 may determine the target penetration depth $D_{target}$ periodically while executing various steps of method 900 or between the various steps of method 900. By estimating $D_{target}$ periodically in this manner, controller 44 may help ensure that the most updated value of $D_{target}$ may be available in step 918. When controller 44 determines that the target penetration depth has been reached in the predefined time (Step 918: Yes) controller 44 may proceed to, for example, step 414 of method 400. When controller 44 determines, however, that the target penetration depth has not been reached in the predefined time (Step 918: No) controller 44 may return to step 904 to perform additional rack/unrack cycles. By repeatedly racking and unracking work tool 16 in this manner, controller 44 may ensure that work tool 16 can cut pile face 42 of material pile 34 by a desired amount. This in turn may ensure that work tool 16 may be able to remove a desired amount of material from pile face 42 of material pile 34 in each excavation cycle to improve an efficiency of operation of machine 10.

It will be apparent to those skilled in the art that various modifications and variations can be made to the disclosed excavation system. Other embodiments will be apparent to those skilled in the art from consideration of the specification and practice of the disclosed excavation system. It is intended that the specification and examples be considered as exemplary only, with a true scope being indicated by the following claims and their equivalents.

What is claimed is:

1. An excavation system for a machine having a work tool, comprising:

a speed sensor configured to generate a first signal indicative of a travel speed of the machine;

at least one load sensor configured to generate a second signal indicative of loading of the work tool;

a controller in communication with the speed sensor and the at least one load sensor, the controller being configured to:

detect engagement of the work tool with a material pile based on at least one of the first signal and the second signal;

select at least one tilt control parameter value for the work tool;

operate the work tool based on the selected tilt control parameter value to load the work tool with an amount of material;

determine whether the amount of material exceeds a target amount;

cause the machine to withdraw from the material pile when the amount exceeds the target amount; and wherein the controller is further configured to position a wheel of the machine by raising the work tool to a target height above a ground surface.

2. The excavation system of claim 1, wherein the controller is configured to select the tilt control parameter value by:

determining an angle of repose;

selecting the tilt control parameter value from steep face tilt control parameter values when the angle of repose exceeds a steep face threshold;

selecting the tilt control parameter value from shallow face tilt control parameter values when the angle of repose is less than a shallow face threshold; and selecting the tilt control parameter value from normal face tilt control parameter values when the angle of repose lies between the shallow face threshold and the steep face threshold.

3. The excavation system of claim 2, wherein the tilt control parameter value is at least one of a minimum tip angle of the work tool, a maximum tip angle of the work tool, a maximum rack angle, a maximum unrack angle, a maximum rack time, a maximum unrack time, a maximum rack velocity, a maximum unrack velocity, a maximum pressure in a lift actuator, and a maximum pressure in a tilt actuator.

4. The excavation system of claim 2, wherein the at least one tilt control parameter value includes a first set of tilt control parameter values, and the controller is further configured to:

select a second set of tilt control parameter values that are penetration focused from the first set of tilt control parameter values;

operate the work tool based on the second set of tilt control parameter values until a penetration condition is satisfied;

select a third set of tilt control parameter values that is face cut focused from the first set of tilt control parameter values; and operate the work tool based on the third set of tilt control parameter values until a face cut condition is satisfied.

5. The excavation system of claim 4, wherein the controller is configured to operate the work tool by:

racking the work tool until a rack angle exceeds a threshold rack angle; and unracking the work tool when the rack angle exceeds the threshold rack angle.

6. The excavation system of claim 4, wherein the controller is configured to operate the work tool by:

racking the work tool until a rack time exceeds a threshold rack time; and unracking the work tool when the rack time exceeds the threshold rack time.

7. The excavation system of claim 1, wherein the controller is further configured to:

determine an angle of repose;

determine a target penetration depth based on the angle of repose.

8. The excavation system of claim 7, wherein the at least one tilt control parameter value includes a first set of tilt control parameter values, and the controller configured to:

select the first set of tilt control parameter values that are penetration focused;

operate the work tool based on the first set of tilt control parameter values until a penetration condition is satisfied;

select a second set of tilt control parameter values that is face cut focused; and operate the work tool based on the second set of tilt control parameter values until a face cut condition is satisfied.

9. A method of controlling a machine having a work tool, comprising:

sensing, by a controller, a first parameter from a speed sensor indicative of a travel speed of the machine;

sensing, by the controller, at least a second parameter from at least one load sensor indicative of loading of the work tool;

detecting, by the controller, engagement of the work tool with a material pile based on at least one of the first parameter and the second parameter;

selecting, by the controller, at least one tilt control parameter value for the work tool;

operating, by the controller, the work tool based on the selected tilt control parameter value to load the work tool with an amount of material;

determining, by the controller, whether the amount of material exceeds a target amount;

causing, by the controller, the machine to withdraw from the material pile when the amount exceeds the target amount; and wherein the method further includes positioning a wheel, by the controller, of the machine by raising the work tool away from a ground surface to a target height.

10. The method of claim 9, further including:

determining, by the controller, an angle of repose; and determining, by the controller, a target penetration depth based on the angle of repose.

11. The method of claim 9, wherein the tilt control parameter value includes at least one of a minimum tilt angle of the work tool, a maximum tilt angle of the work tool, a maximum rack angle, a maximum unrack angle, a maximum rack time, a maximum unrack time, a maximum rack velocity, a maximum unrack velocity, a maximum pressure in a lift actuator, and a maximum pressure in a tilt actuator.

12. The method of claim 9, wherein the at least one tilt control parameter value includes a first set of tilt control parameter values, and the method further includes:

selecting, by the controller, the first set of tilt control parameter values that are penetration focused;

operating, by the controller, the work tool based on the first set of tilt control parameter values until a penetration condition is satisfied;

selecting, by the controller, a second set of tilt control parameter values that are face cut focused; and operating, by the controller, the work tool based on the second set of tilt control parameter values until a face cut condition is satisfied.

13. The method of claim 12, wherein operating the work tool includes:

racking, by the controller, the work tool until a rack angle exceeds a threshold rack angle; and unracking, by the controller, the work tool when the rack angle exceeds the threshold rack angle.

14. The method of claim 12, wherein operating the work tool includes:

racking, by the controller, the work tool until a rack time exceeds a threshold rack time; and unracking the work tool when the rack time exceeds the threshold rack time.

15. The method of claim 12, wherein the penetration condition is satisfied when at least one of a penetration rate is less than a target penetration rate and a penetration depth exceeds a target penetration depth.

16. The method of claim 12, wherein the face cut condition is satisfied when a target penetration depth is reached in a predefined time.

17. A machine, comprising:

a frame;

a plurality of wheels rotatably connected to the frame and configured to support the frame;

a power source mounted to the frame and configured to drive the plurality of wheels;

a work tool operatively connected to the frame, driven by the power source, and having a tip configured to engage a material pile;

a speed sensor associated with the plurality of wheels and configured to generate a first signal indicative of a travel speed of the machine;

a torque sensor associated with the power source and configured to generate a second signal indicative of a torque output of the power source;

an acceleration sensor configured to generate a third signal indicative of an acceleration of the machine; and a controller in communication with the speed sensor, the torque sensor, and the acceleration sensor, the controller being configured to:

detect engagement of the work tool with the material pile based on at least one of the first, second, and third signals;

select at least one tilt control parameter value for the work tool;

operate the work tool based on the selected tilt control parameter value to load the work tool with an amount of material from the material pile;

determine whether the amount of material exceeds a target amount;

cause the machine to withdraw from the material pile when the amount exceeds the target amount; and wherein the at least one tilt control parameter value includes a threshold rack angle and a threshold unrack angle, and operating the work tool includes:

racking the work tool until a rack angle exceeds the threshold rack angle; and unracking the work tool until an unrack angle is less than the threshold unrack angle.

* * * * *